US006129639A

United States Patent [19]

Brock et al.

[11] Patent Number: 6,129,639

[45] Date of Patent: Oct. 10, 2000

[54] PUTTING TRAINER

[76] Inventors: Carl W. Brock, 203 Oak Ridge Ct., Greer, S.C. 29650; Claude Timothy Mayfield, 820 Butler Springs Rd., Greenville, S.C. 29615

[21] Appl. No.: 09/257,392

[22] Filed: Feb. 25, 1999

[51] Int. Cl.[7] ..... A63B 69/36

[52] U.S. Cl. ..... 473/260; 473/264; 473/265

[58] Field of Search ..... 473/257, 258, 473/260, 261, 264, 265

[56] References Cited

U.S. PATENT DOCUMENTS

| | | | |
|---|---|---|---|
| 2,754,125 | 7/1956 | Engler | 273/192 |
| 3,269,733 | 8/1966 | Taddie et al. | 273/183 |
| 3,857,570 | 12/1974 | Gutierrez et al. | 273/186 C |
| 4,129,301 | 12/1978 | Kenney | 273/186 R |
| 5,007,646 | 4/1991 | Baber et al. | 473/261 |
| 5,037,100 | 8/1991 | Montgomery, Sr. | 273/183 E |
| 5,150,904 | 9/1992 | Sindelar | 473/261 X |
| 5,209,484 | 5/1993 | Randall | 273/192 |
| 5,282,627 | 2/1994 | Beck | 273/186.1 |
| 5,503,395 | 4/1996 | Cook | 273/186.1 |
| 5,586,945 | 12/1996 | Vonderhaar | 473/258 |
| 5,776,007 | 7/1998 | Kendall et al. | 473/260 X |

*Primary Examiner*—George J. Marlo
*Attorney, Agent, or Firm*—Henry Jaudon; Cort Flint

[57] ABSTRACT

A putting trainer for assisting a golfer perfect his address, the address of the putter, and the putting stroke. The trainer is designed for use on a support surface with a golf ball and a putter. The trainer includes a pair of spaced base members carrying a pair of parallel longitudinally positioned curtains which are arranged perpendicular of a target and in an elevated position which is slightly greater than the height of the ball and the putter blade. The curtains are laterally spaced a distance which is slightly greater than the width of the ball. A guide, which is parallel with the curtains and laterally spaced therefrom a distance equal the distance between the heel and the sweet spot of the putter, is adjustably secured with the base members. In use, with the ball placed between and beneath the curtains with the blade beneath and perpendicular of the curtains, the sweet spot adjacent the ball, and the heel in engagement with said guide. A golfer in proper address will be positioned with his eyes squarely over the ball so that all of the ball between the curtains is seen. A proper stroke will maintain the heel in engagement with the guide and the blade beneath the curtains. An improper address will not position the eyes squarely over the ball which will cause one of the curtains to shield at least a portion of the ball. An improper stroke will move the heel of the putter away from the guide which may cause the putter blade to contact the curtains or to strike the ball at an angle causing it to deviate from the desired line. On a proper stroke the putter blade will strike the ball squarely and cause it to move along the desired line to the target.

17 Claims, 3 Drawing Sheets

PUTTING TRAINER

BACKGROUND OF THE INVENTION

This invention is directed to a putter trainer which addresses several requirements for obtaining and maintaining a proper putting stroke while at the same time being portable and inexpensive.

Putting training devices are well known as illustrated by U.S. Pat. Nos. 5,586,945; 5,209,484; 5,037,100; and 3,857,570. Each of these devices are designed to improve or correct certain aspects of proper putting while failing to address all requirements.

In order for the ball to travel on a line which will have it pass through the target opening, it must be struck squarely with the putter blade which is brought about with a proper putting stroke.

Accordingly, it is an object of this invention to provide a putting trainer which provides training for the major requirements for a proper putting stroke.

Another object of the invention is a putting trainer which is compact.

Another object of the invention is a putting trainer which is inexpensive.

Another object of the invention is a putting trainer which is lightweight and portable.

Another object of the invention is a putting trainer which addresses proper address with the golfer's eyes clearly over the ball with no visual obstruction and with the putter blade square to ball.

Another object of the invention is a putting trainer which assists in the development of proper stroke line and distance.

Another object of the invention is a putting trainer which develops a putting stroke while keeping the putter blade low to the ground during the stroke.

SUMMARY OF THE INVENTION

The invention is directed to a putting trainer for assisting a golfer to perfect address and stroke during putting. The trainer is designed for use on a support surface with a ball and a putter having a blade with a sweet spot and a heel. The trainer includes a pair of parallel and longitudinally positioned curtains or rails arranged perpendicular of a target. The curtains are in an elevated position which is slightly greater than the height of the ball and the blade. The curtains are laterally spaced a distance which is slightly greater than the width of the ball.

An adjustable guide is positioned on the support surface in parallel relation with the curtains. The guide is laterally spaced from the curtains a distance which is equal the distance between the heel and the sweet spot of the putter.

The trainer is adapted to have the ball placed between and beneath the curtains with the blade of the putter also beneath and perpendicular of the curtains with the sweet spot adjacent the ball. The said heel is in engagement with the guide. With the elements so arranged, a golfer, in proper address, will see all of the ball between the curtains. Also, a proper stroke will maintain the heel in engagement with the guide throughout. Alternatively, an improper address will cause one of the curtains to shield at least a portion of the ball and an improper stroke will cause the heel to move away from the guide.

The trainer includes a pair of base members each having an upper surface, a lower surface, a pair of side surfaces. The target comprises a C-shaped opening formed intermediate of the lower surface of each of the base members. An insert is provided for the C-shaped opening providing for the target to be one of a plurality of selected sizes.

Opposed ends of the curtains are removably connected with each of the base members adjacent the upper surface. Connectors connect each of the ends of guide with each of the base members adjacent the lower surface thereof. The connectors provide an adjustable connection of the guide transversely of the curtains.

First and second caps, which are adjustably positioned along top portions of the curtains, are provided. The caps are positioned on each side of the ball and function to monitor the length of the back and forward stroke.

The curtains are constructed with a selected vertical height. Normally, the height of the curtain most distant from the guide is greater than the vertical height of the nearer curtain because the size of individual putters vary most near the putter shaft.

The putting training frame, which may be made of plastic, comprises a guide bar which is about 36" long and about 1" high and is connected at each end with a lower corner portion of a base member. A C-shaped opening is formed intermediate the lower edge of each of the base members and transverse of the guide bar. A pair of parallel and longitudinally extending rails are connected at opposite ends with a base member adjacent its upper edge. The rails are raised above the support surface a selected distance and are laterally spaced by about 1⅞" or a distance substantially equal the width of the C-shaped opening.

A golf ball is positioned beneath and between the first and second rails and a putter having a blade with a heel is positioned beneath the first and second rails with the heel in contact with the guide and the blade adjacent the ball and perpendicular of the first and second rails. The trainer is designed to monitor the address of the golfer between to far, to close, or properly over the ball. Also, the trainer is designed to monitor the angular position of the blade relative to the ball and the stroke are of the golfer by the relationship of the putter heel and the guide bar and the putter blade relative to the spaced rails. Also, adjustable caps positioned on the rails monitor the length of the stroke.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
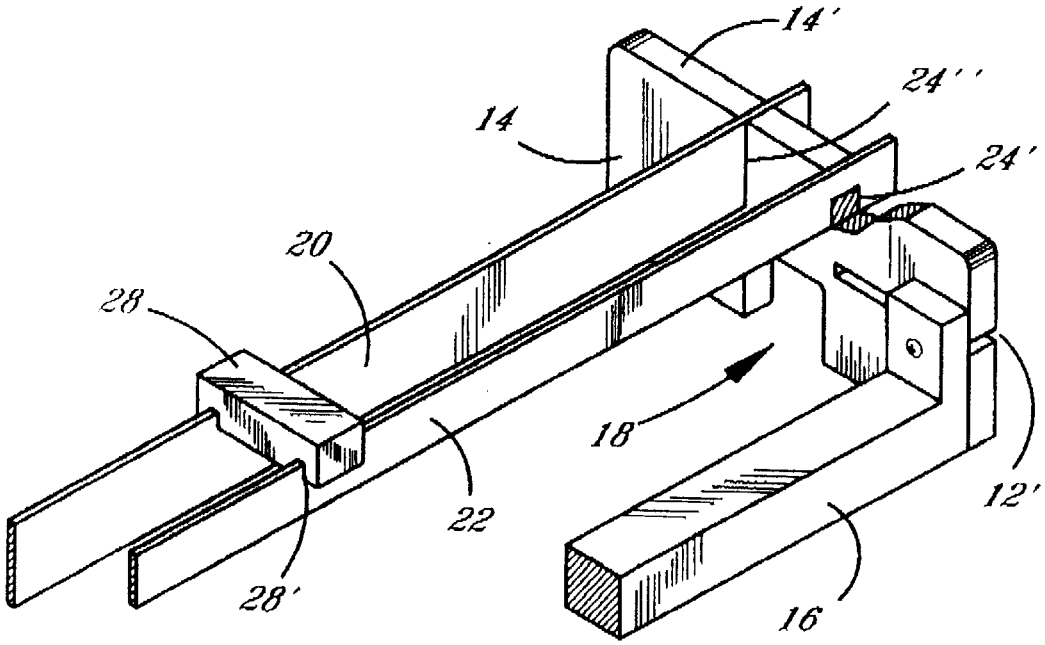
FIG. 1 is a broken-away perspective view of an end of the putting trainer.

Referring now to the drawings, the invention will now be described in more detail.

Figure 2:
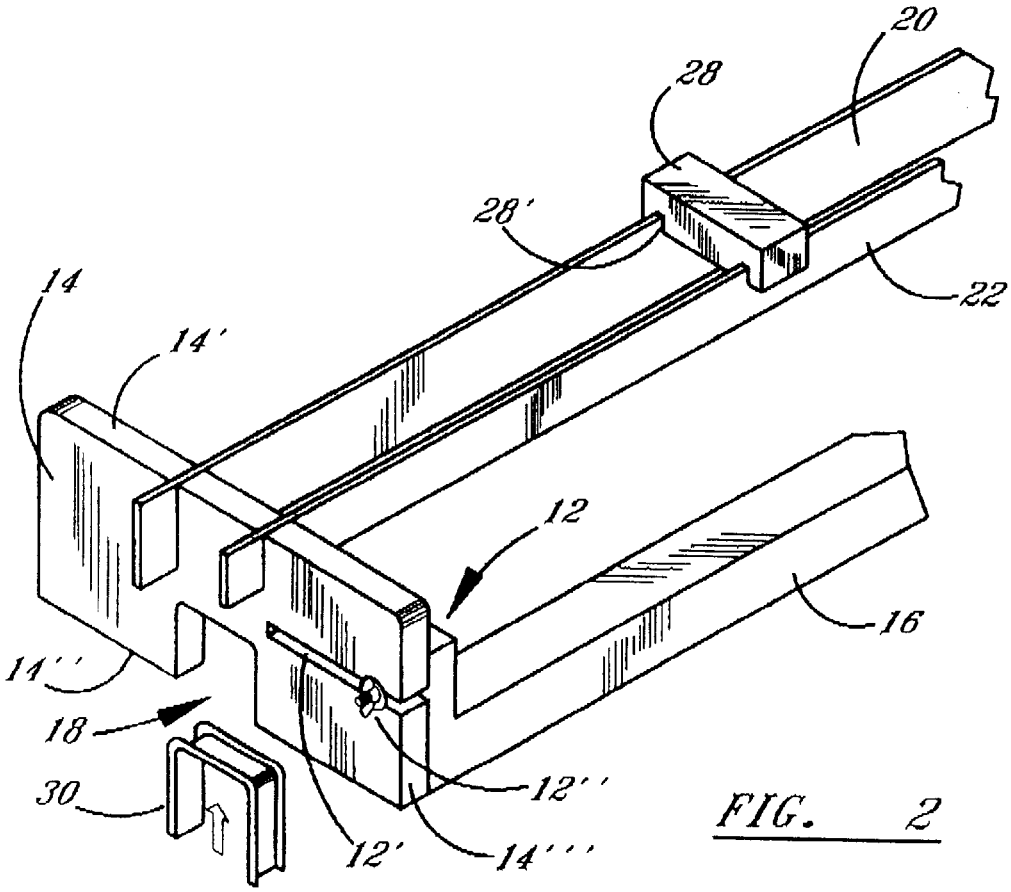
FIG. 2 is a broken-away perspective view of the opposite end of the putting trainer.

FIGS. 1 and 2 show perspective sectional views of the putting trainer. The trainer comprises first and second base members 14 which are spaced by about 36" although they could be farther apart or closer together. Each base member includes top 14', bottom 14", and opposed ends 14'". Bottom rail or guide bar 16 is attached at its opposed ends with each of base members 14 adjacent a first of its opposed ends 14'". Guide bar 16 is adapted to engage with inner sides of base members 14 with its lower surface parallel with bottom 14" of each base member 14. It is desirable to have guide bar 16 slightly elevated above bottom 14" by between about ⅛" and 3/16" to accommodate uneven ground surfaces.

A connector 12 adjustably connects each end of guide bar 16 with base members 14. Connector 12 includes a slot 12' formed in each base member 14. A threaded rod 12" connected with the opposed ends of guide bar 16 passes through a slot 12' and is secured with the base member by a lock nut. Connectors 12 maintain guide bar 16 perpendicularly of base members 14. Also, connectors 12 allow guide bar 16 to be adjusted transversely of the base members.

Connectors of other construction may be utilized to connect the guide bar with the base members. It is only required that the guide bar be transversely adjustable and be maintained perpendicular of the base members.

Intermediate each base member 14, a target or C-shaped opening 18 is formed along bottom 14". Opening 18 is about 2¼" wide by 2¼" high which allows ample space for a golf ball to pass through. Should it be desired that the opening be smaller, an insert 30 is provided. The insert is designed to friction fit into opening 18 and to reduce its width and height by about ½". The opening, in reduced form, simply requires a more accurate putt in order for the ball to pass through. Generally, the more advanced putters prefer the smaller opening.

An optional arrangement would be to simply provide an advanced arrangement with only the smaller target opening.

A pair of curtains or rails 20, 22 are arranged intermediate of top 14' of each block 14. Rails 20, 22 are slightly longer than 36", as their opposed ends project beyond each of the base members.

Each curtain or rail 20, 22 is formed at about ¼" thick with planar side surfaces in a rectangular shaped cross-section. Rail 20 is between 1¾" and 2¼" in height while rail 22 may be the same height or, in most cases, about as ¾" less in order to accommodate the height of the putter blade adjacent the putter shaft. Curtains 20, 22 are spaced from each other by about 1⅞" or just slightly more than the width of a standard USGA golf ball.

Connectors 24 connect opposed ends of rails 20, 22 with each base member 14. Each connector comprises a notch 24' formed along the lower edge of rails 20, 22 and a groove formed from top 14' into base member 14. Connectors 24, which position rails or curtains 20, 22 parallel with each other and with guide bar 16, are also spaced from each other by about 1⅞".

Again other type connectors may be used with the only requirement being that rails 20, 22 be maintained parallel with each other and perpendicular with base members 14. It is within the scope of the invention to have the base members and rails formed as a unitary member.

A pair of caps 28 are provided for slidably mounting on top of rails 20, 22. Each cap 28 includes a pair of grooves 28' which are spaced equidistant of grooves 24" and functions to stabilize and maintain rails 20 and 22.

Figure 3:
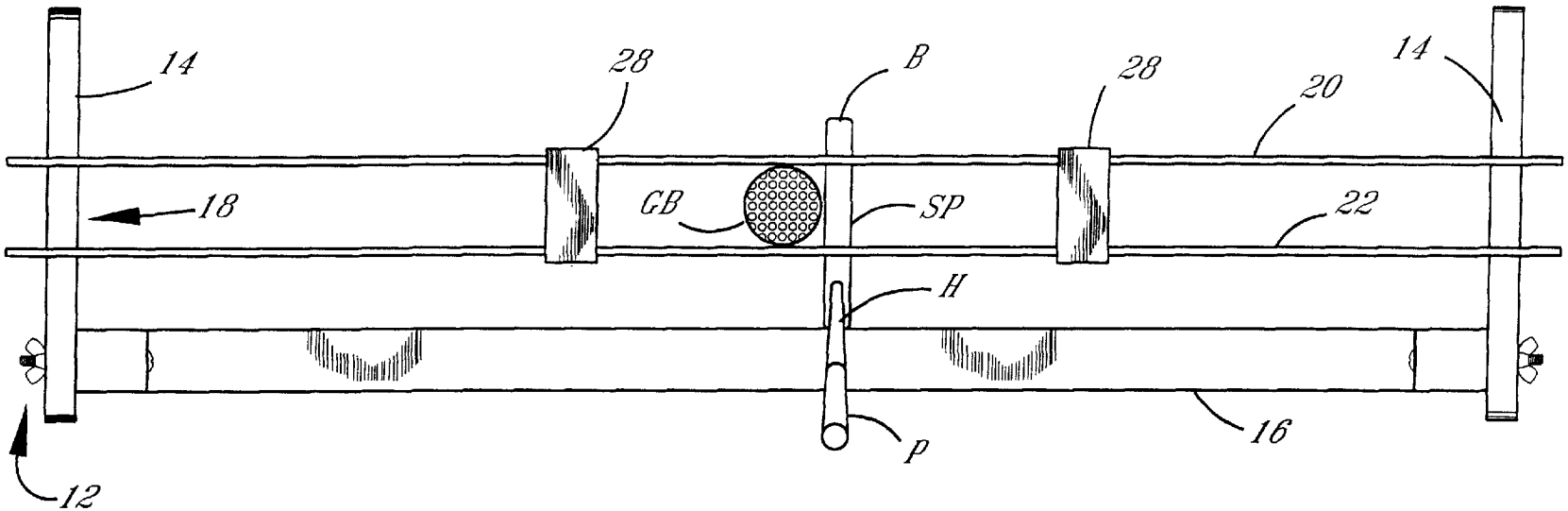
FIG. 3 is a top view of the putting trainer.
Figure 4:
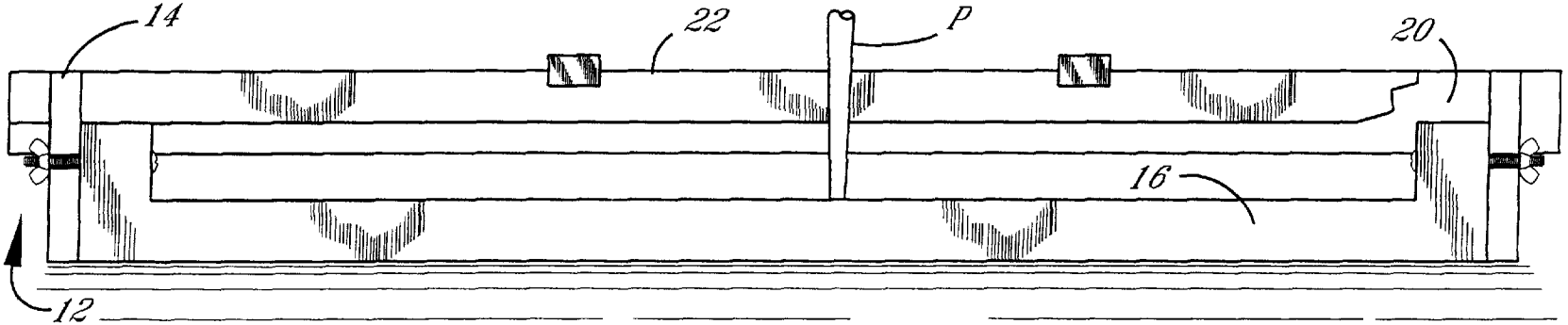
FIG. 4 is a side view of the putting trainer.

Turning now to FIGS. 3 and 4, putter trainer is seen positioned on a support surface with a golf ball GB positioned substantially centrally of base members 14. Putter P is shown with blade B positioned beneath curtains 20, 22 with sweet spot SP directly behind ball GB. The heel 14 of blade B is in contact with the inner face of guide bar 16.

Figure 5:
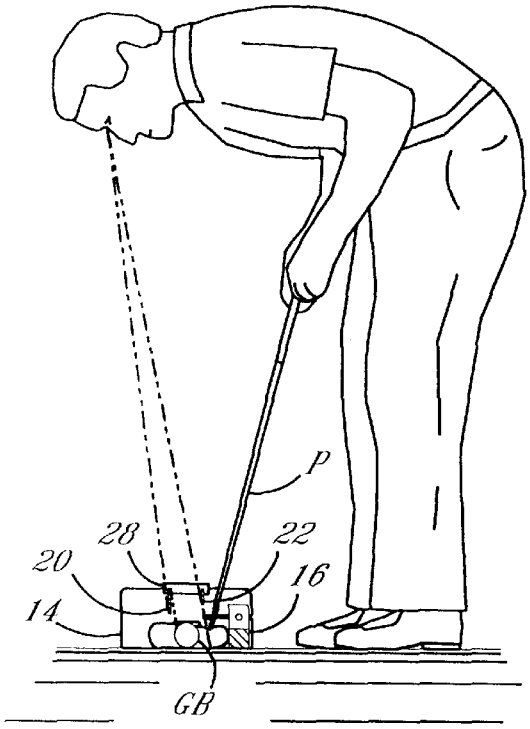
FIG. 5 is a sectional site view of the putting trainer with a golfer in improper position.
Figure 5A:
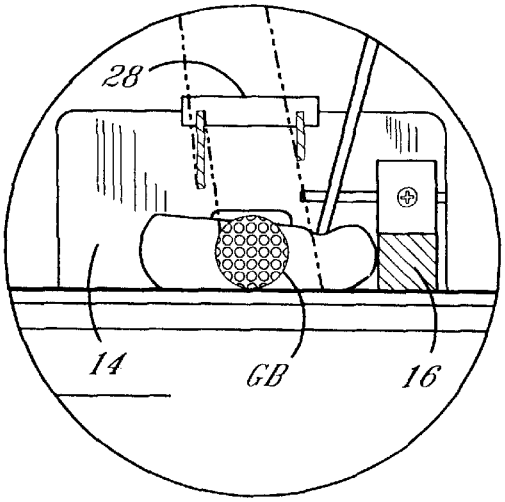
FIG. 5A is a blow-up of the putter, ball, trainer, and sight path as shown in FIG. 5.
Figure 6:
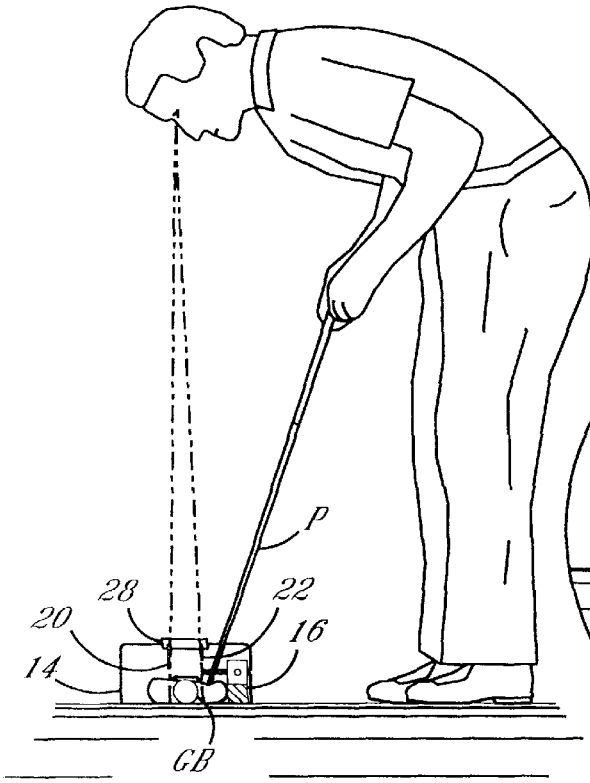
FIG. 6 is a sectional view similar to FIG. 5 with the golfer in proper position; and, FIG. 6A is a blow-up of the putter, ball, trainer, and sight path as shown in FIG. 6.
Figure 6A:
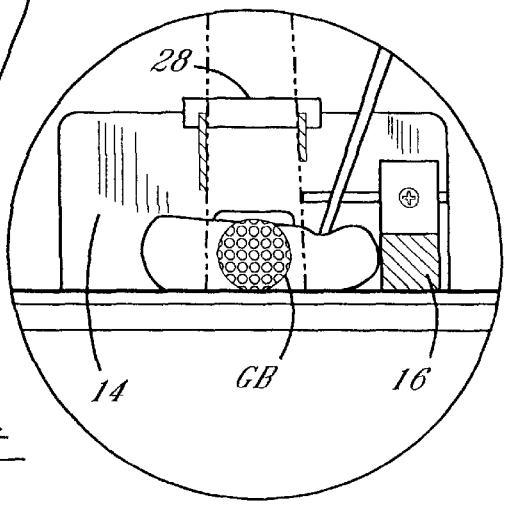

When the golfer addresses the ball with the club so positioned, the correct address positions the eyes directly or squarely over the ball so that the entire ball is seen as shown in FIG. 6. An incorrect position will locate the eyes to one side of rails 20, 22. In this position the rail to the side of over position will block the line of sight and, therefore, block vision of a portion of the ball as shown in FIG. 5. This arrangement brings about immediate correction of address.

Rails 20, 22 further function to assist in aligning blade B of putter P square with the target which is perpendicular with rails 20, 22. Rails 20, 22 also act to maintain blade B of putter P low and substantially parallel with the support surface during the back and forward motions of the putting strokes. Guide 16, against which heel H remains in contact with throughout the putting stroke, assures that the stroke remains along the axis of intended trajectory. And finally, caps 28 are positioned to define limits which indicate the desired length of the back and forward strokes.

Continued practice with the described putting trainer will condition the golfer to automatically assume proper address with the eyes directly over the ball, with the putter blade square with the target and with the sweet spot directly behind the ball. The stroke will reflexively be low to the ground, along a controlled arc with the putter blade positioned perpendicular of the target.

While a preferred embodiment of the invention has been described using specific terms, such description is for illustrative purposes only, and it is to be understood that changes and variations may be made without departing from the spirit or scope of the following claims.

What is claimed is:

1. A putting trainer frame comprising:

a guide bar of selected width and length, said guide bar having a height of at least 1" and a connector at each end;

first and second rails of selected width and length, said first rail having a first height and said second rail having a second height less than said first height;

first and second base members, each said base member having a top, a bottom, a pair of ends, and first and second sides with a C-shaped opening formed intermediate of said bottom;

a lower connector arranged adjacent said bottom and a selected of said ends of each of said base members, said lower connectors connecting with a selected of said connectors of said guide bar;

first and second connectors located adjacent said top and intermediate said ends of said first and second base members, said first and second connector being spaced by at least 1⅞", said first connectors connecting with opposed ends of said first rail and said second connector connecting with opposed ends of said second rail;

a golf ball adapted to be positioned beneath and between said first and second rails;

a putter having a blade with a heel adapted to be positioned beneath said first and second rails with said heel in contact with said guide and said blade adjacent said ball and perpendicular of said first and second rails; whereby, said trainer provides for monitoring of address and stroke.

2. A putting trainer for assisting a golfer to perfect address and stroke during putting, said trainer being designed for use with a ball of predetermined height and width and a putter having a blade of predetermined height having a sweet spot located at a predetermined distance from a heel, said trainer comprising:

a pair of parallel longitudinally positioned curtains having planar side surfaces, said curtains being arranged perpendicular of a target with their lower surfaces at a height greater than said predetermined height of said ball and said blade, said curtains being laterally spaced a width greater than said predetermined width of said ball;

an adjustable guide having an inner face positioned on a support surface parallel with said curtains, said inner face of said guide being laterally spaced from an axis through said target a distance equal said predetermined distance between said heel and said sweet spot; wherein, said trainer functions with the golfer in position, with said ball between said curtains, with said puffer blade beneath and perpendicular of said curtains with said sweet spot along said axis and adjacent said ball and with said heel in engagement with said guide to indicate a proper address by allowing the golfer to see all of said ball between said curtains and to indicate a proper stroke when said heel is maintained in engagement with said guide.

3. The trainer according to claim 2 including a pair of base members having an upper surface, a lower surface, a pair of side surfaces;

said target comprising a C-shaped opening formed intermediate of said lower surface of said base members.

4. The trainer of claim 3 including an insert for said C-shaped opening whereby said target may be one of a plurality of selected sizes.

5. The trainer of claim 3 wherein opposed ends of said curtains are connected with a selected of said base members adjacent said upper surface.

6. The trainer of claim 3 wherein connectors connect opposed ends of said guide with said base members adjacent said lower surface.

7. The trainer of claim 6 wherein said connectors provide adjustment of said guide transversely of said curtains.

8. The trainer of claim 3 wherein said curtains are removably connected with said base members.

9. The trainer of claim 2 including first and second caps adjustably positioned along top portions of said curtains, said caps being positioned relative to said ball to monitor length of said stroke.

10. The trainer of claim 2 wherein said planar surfaces of each said curtains have a selected vertical height.

11. The trainer of claim 10 wherein said vertical height of a first of said planar surfaces is greater than said vertical height of a second of said planar surfaces.

12. The trainer of claim 11 wherein said first of said curtains is further from said guide than said second of said curtains.

13. The trainer of claim 2 wherein said trainer is plastic.

14. The trainer of claim 2 wherein curtains are approximately 36" in length and 2" in height.

15. A putting trainer for assisting a golfer to develop a proper putting address and stroke comprising:

a pair of laterally spaced base members each having an upper surface, a lower surface and a pair of side surfaces;

a pair of elongated rectangular shaped curtains having opposed vertically extending planar side surfaces, said curtains being carried at their respective opposed ends by said upper surfaces of said base members in spaced parallel relationship;

a C-shaped target formed in at least one of said base members along said lower surface said target having an axis positioned intermediate of and parallel with said curtains; and, a guide adjustably mounted at opposed ends with said base members, said guide being positionable in parallel with said axis and at selected distances therefrom.

16. The trainer of claim 15 including first and second caps, said caps being adjustably connected with upper surfaces of said curtains at selected spaced positions.

17. The trainer of claim 15 wherein a first of said curtains is of less height than a second of said curtains.

* * * * *